US007974546B2

(12) United States Patent
Robinson

(10) Patent No.: US 7,974,546 B2
(45) Date of Patent: Jul. 5, 2011

(54) SYSTEMS AND METHODS FOR OUTPUTTING FINISHED MEDIUM IN AN IMAGE FORMING DEVICE

(75) Inventor: David C. Robinson, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 1050 days.

(21) Appl. No.: 11/610,184

(22) Filed: Dec. 13, 2006

(65) Prior Publication Data

US 2008/0145090 A1 Jun. 19, 2008

(51) Int. Cl.
*G03G 15/00* (2006.01)

(52) U.S. Cl. ..... 399/82

(58) Field of Classification Search ..... 399/82
See application file for complete search history.

(56) References Cited

U.S. PATENT DOCUMENTS 5,390,910 A * 2/1995 Mandel et al. ..... 271/296
5,961,115 A * 10/1999 Blanck et al. ..... 271/263
2003/0010731 A1* 1/2003 Bartscher et al. ..... 211/50

FOREIGN PATENT DOCUMENTS

JP 10291726 A * 11/1998

OTHER PUBLICATIONS

Machine translation of JP10-291726.*

* cited by examiner

*Primary Examiner* — David M Gray
*Assistant Examiner* — Andrew V Do
(74) *Attorney, Agent, or Firm* — Oliff & Berridge, PLC

(57) ABSTRACT

A system and method for outputting finished image receiving medium in an image forming device are provided. The systems and methods include receiving an image forming operation in an image forming device. The image forming operation is evaluated to determine a number of pages required. Image receiving medium information relevant to an image receiving medium available to the image forming device may be accessed. Stacking thickness may be estimated based on the determined page count and the image receiving medium information. The image forming operation is processed based on the estimated stacking thickness. Processing may include comparing the estimated stacking thickness to an available stacker space and determining, from amongst a plurality of available stackers, a target stacker to deliver finished image receiving media to based on the results of the comparison.

23 Claims, 3 Drawing Sheets

SYSTEMS AND METHODS FOR OUTPUTTING FINISHED MEDIUM IN AN IMAGE FORMING DEVICE

BACKGROUND

This disclosure is directed to systems and methods for outputting finished image receiving media in an image forming device.

Image forming operations are received in various manners by image forming devices. Image forming operations, such as, for example printing instructions, may be received via electronic networks including intranet and extranet electronic communications or by direct loading. Image forming operations are typically processed by image forming devices to produce a representation of an electronic image or reproducing an image previously produced on an input image receiving medium, onto an available output image receiving medium such as, for example, a print sheet. Images may be produced, and/or reproduced on the output image receiving medium in a variety of manners including, for example, electrostatic xerographic, inkjet deposition and by other like or related image forming processes.

Image forming operations often include page count requirements or estimates. However, such estimates may not always be accurate relative to actual output requirements such as, for example, the specific page count of output printed documents. Such differences may result from a variety of reasons such as, for example, specific formatting requirements of an image forming device, and/or available output image receiving medium size.

The term "image forming device," as used here, broadly encompasses, but is not limited to, various printers, copiers, facsimile machines, multi-function devices and/or other like systems. The term "sheet" will be used to refer generally to an output image receiving medium that is generally represented by a pliable physical sheet of paper, plastic, or other suitable physical substrate for receiving output images based on image forming operations in the image forming devices. A compiled, collated set of output image receiving media may be alternatively referred to as a document, booklet, or the like. It is also known to use interposers or inserters to add covers or other inserts to a compiled set of output image receiving media.

A common feature among image forming devices is the delivery of finished image receiving media into output trays or stackers. The results of a particular image forming operation have a particular resulting stack thickness in the receiving stacker. Image forming devices may use multiple stackers for receiving finished output image receiving media. Multiple stacker configurations may include those that receive multiple copies of a single image forming operation in separate stackers, or a series of stackers may be used in sequence to receive the output image receiving media.

In conventional systems having multiple stacker configurations, a primary destination stacker is normally filled before an alternate destination stacker is employed. Conventional systems may use sensors that determine when an individual output stacker is filled to capacity. The sequencing of output destination stackers leads to a set of output image receiving media being delivered to a "top" of a stacker being stacked in both the primary and alternate destination stacker(s). The splitting of the output media produced by an image forming operation between destination stackers leads to a later requirement for media reassembly such as, for example, manually, after the output media from a single image forming operation is removed from separate destination stackers.

Inage forming devices employ a variety of media with differing characteristics that affect stacking thickness of a finished set of image receiving media. Such characteristics may include individual image receiving medium thickness and composition. These qualities affect stacking thickness directly and indirectly. Indirect effects may include the medium stacking thickness after the medium is separated and re-stacked. Various media may also react to compression differently based on their composition.

In addition to the various image receiving media that an image forming device may use, image forming devices employ a variety of image production and reproduction methods that independently affect stacking thickness. Such methods may include electrostatic or inkjet application of toner particles to an image receiving medium. The thickness of the deposited toner particles may affect overall output image receiving medium stacking thickness. Also, in a case where varying amounts of toner are deposited per page, the result may be different with respect to individual pages within an image forming operation.

Other effects of image forming processes on an individual image receiving medium that may affect stacking thickness include thermal expansion in, and electrostatic charging of, the image receiving medium to effect image forming operations on the image receiving medium.

SUMMARY

Various combinations of the above-identified factors may make it difficult to estimate a stacking thickness of a particular image forming operation received by an image forming device. As a result, an available output stacker may be filled by only a portion of a full set of output image receiving media produced in a single image forming operation. When the results of a single image forming operation cannot be accommodated in a single output stacker, difficulties may arise in operation of the image forming device for instance when a selected destination stacker becomes physically overburdened, or inefficiencies may occur as may be, for example, incumbent in a requirement to manually collate the results of a single image forming operation split between multiple destination stackers in the image forming device.

It may, therefore, be advantageous to provide systems and methods by which various of the foregoing factors could be relied upon to more accurately estimate a stacking thickness for processing an image forming operation in an image forming device. It may be advantageous to use the estimated stacking thickness in determining whether an available stacking space in a primary destination stacker is adequate for receiving a full set of image receiving media associated with a the image forming operation.

It may be further advantageous to provide systems and methods in which an image forming operation may be delivered to an output destination stacker in which it is known that there is sufficient stacking space for receiving a particular complete set of output image receiving media.

Alternatively, if such space will not be available, it would be advantageous to provide a user with an indication that the media thickness will exceed the capacity of the available destination stacker in order to allow the user to choose whether to proceed with the image forming operation or to otherwise adjust the system such as, for example, emptying an output stacker, before allowing the image forming operation to proceed.

In various exemplary embodiments, the systems and methods according to this disclosure may provide an image forming device including one or more output destination stackers with an enhanced processing function to allow the image forming device to estimate, or to be provided with an estimate of, a stacking thickness for an image forming operation and to assess the capacity of the one or more destination stackers to receive the full set of image receiving media associated with an image forming operation.

In various exemplary embodiments, the systems and methods according to this disclosure may estimate a stacking thickness of a full set of output image receiving media associated with a particular image forming operation. Given this estimate, the systems and methods according to this disclosure may adjust processing of an image forming operation in an image forming device based on the estimated stacking thickness. Adjustment of the processing of the image forming operation may include providing a user with a warning that a particular destination stacker will be overloaded if the entire image forming operation is processed. Alternatively, a user may be warned that a particular image forming operation will be separated between two destination stackers.

In exemplary embodiments, the systems and methods according to this disclosure may afford a user an opportunity to, or the image forming device may automatically, select an output destination stacker for output based on an estimated stacking thickness of the full set of output image receiving media associated with an image forming operation and a known stacking capacity and/or a sensed condition of a particular output destination stacker, i.e., whether there is already an amount of output image receiving media present in the selected output destination stacker.

In various exemplary embodiments, systems and methods according to this disclosure may provide enhanced capability for automatically or manually selecting an output destination slacker from among a plurality of available output destination stackers.

In various exemplary embodiments of the disclosed systems and methods, once an image forming device receives instructions for an image forming operation, the image forming operation may be evaluated to determine or estimate a number of pages required. As used herein, such a determination or estimation of number of pages required will be referred to simply as "determining." It should be understood that, as used herein, a determined number of pages required may include an estimate of number of pages required if, for example, insufficient information is available to make a determination.

Image receiving medium information relevant to characteristics of image receiving media available to the image forming device may be accessed from, for example, a database stored in a memory. This information may include, but not be limited to, information regarding image receiving media that is directly available to a specific image forming device, or information regarding image receiving media that is otherwise "available" to the image forming device via networked image forming devices that are configured to receive image forming operations communicated through the network.

A stacking thickness may be estimated based on the determined page count and the image forming medium information. The image forming operation may be processed based on the estimated stacking thickness.

In accordance with exemplary embodiments, the image receiving medium information may include, but not be limited to, medium thickness, medium stacking thickness, medium stacking thickness based on effects imposed on the image receiving medium during image forming such as, for example, thermal expansion and/or electrostatic charging, medium stacking thickness based on medium composition, and/or medium stacking thickness based on deposited toner thickness.

In accordance with exemplary embodiments, evaluating an image forming operation may take place prior to complete receipt of the image forming operation in the image forming device.

In accordance with exemplary embodiments, the image receiving medium information may be updated by control circuitry within the image forming device based on stacking information gathered from the image forming device.

Exemplary embodiments of the disclosed systems and methods may employ at least one image forming device that may include a plurality of output destination stackers for receiving output image receiving media from the image forming device. An output control device may selectively direct finished image receiving media from the image forming device to one or more of the plurality of output destination stackers. Control circuitry may be operatively connected to the image forming device and/or an output control device and may be configured to receive an image forming operation, evaluate the image forming operation to determine a number of pages required, access image receiving media information, estimate a stacking thickness based on the determined number of pages required and the image receiving media information, and process the image forming operation based on the estimated stacking thickness.

Exemplary embodiments of the disclosed systems and methods may include processing the image forming operation based on comparing the estimated stacking thickness to an available stacking space in an output destination stacker, and determining, from among a plurality of available output destination stackers, a target destination stacker with available stacking space sufficient to accommodate the estimated stacking thickness of the finished output media associated with the image forming operation. Finished image receiving media from the image forming device may be delivered to the target destination stacker based on this determination.

In accordance with exemplary embodiments of the disclosed systems and methods, a computer program product may be provided on which is recorded a set of computer-executable instructions for enabling a computer to control the output of an image forting device based on a determined estimated stacking thickness. The computer program product may include software instructions that enable the computer to perform predetermined operations, and a computer readable medium bearing the software instructions. The predetermined operations may include: receiving an image forming operation in an image forming device, evaluating the image forming operation to determine a number of pages required, accessing image receiving media information relevant to an image receiving medium available to the image forming device, estimating a stacking thickness based on the determined page count and the image receiving media information, and processing the image forming operation based on the estimated stacking thickness.

These and other objects, advantages and features of the systems and methods according to this disclosure are described and/or are apparent from, the following description of exemplary embodiments.

BRIEF DESCRIPTION OF THE DRAWINGS

Various exemplary embodiments of the disclosed systems and methods will be described, in detail, with reference to the following figures, wherein.

DETAILED DESCRIPTION OF EMBODIMENTS

The following description of various exemplary embodiments of systems and methods for controlling output of finished image receiving media in an image forming device may refer to and/or illustrate a xerographic image forming device as a specific type of image forming device for the sake of clarity, familiarity, and ease of depiction and description. However, it should be appreciated that the principles disclosed herein, as outlined and/or discussed below, can be equally applied to any known, or later-developed, system in which, prior to, or during, an image forming operation, it may be desirable to process the image forming operation based on an estimated stacking thickness of a full set of image receiving media associated with the image forming operation to one or more output destination stackers based on known or sensed capacity of a specific output stacker in the destination stacker.

Figure 1:
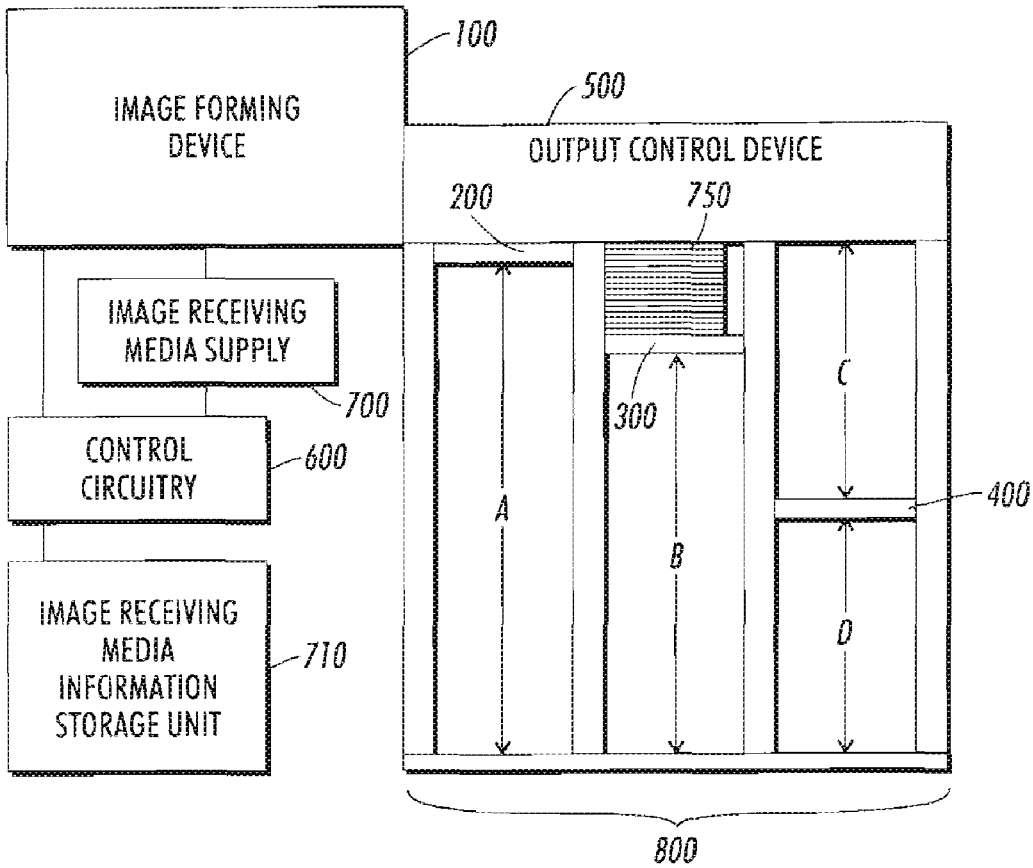
FIG. 1 illustrates a schematic side elevation of a subsystem for outputting finished image receiving media in an image forming device.

FIG. 1 illustrates an exemplary embodiment of and image forming device 100 in which processing an image forming operation may be based on an estimated stacking thickness according to this disclosure. The image forming device 100 may draw image receiving media from at least one image receiving media supply 700 and deliver output image receiving media to one or more of a plurality of output stackers 200, 300 and 400 in one or more output destination multiple stacker system 800. An output control device 500 may direct output image receiving media from the image forming device to the one or more of the plurality of output stackers 200, 300, 400. Control circuitry 600 may be operatively connected to the image forming device 100 and the output control device 500 to provide control of the system as discussed in detail below.

The control circuitry 600 may be configured to receive information regarding an image forming operation to be undertaken by the image forming device 100. Specific processing of this information within the control circuitry 600 may include:

(1) evaluating the image forming operation to determine a number of pages required to complete the image forming operation;

(2) accessing an image receiving media information database storage unit 710 to obtain characteristic information regarding a specified image receiving medium;

(3) estimating a stacking thickness based on the determined number of pages required and accessed image receiving media characteristic information;

(4) comparing an estimated stacking thickness to a known or sensed image receiving medium holding capacity of one or more available output stackers 200, 300, 400 of an output destination multiple stacker system 800;

(5) determining from among the one or more output stackers 200, 300, 400, a specified stacker in the target output destination multiple stacker system 800 with available stacker capacity sufficient to accommodate the estimated stacking thickness of the image forming operation; and (6) processing the image forming operation to the specified stacker based on the estimated stacking thickness, and/or the capacity of the specified stacker to support the estimated stacking thickness.

The output control device 500 may be employed to allow delivery of finished image receiving media to the specified stacker, or to provide other processing inputs based on determinations made in the control circuitry 600.

The image receiving media information database storage unit 710 may be available within, or otherwise in data communication with, the image forming device 100. The image receiving media information database storage unit 710 may provide image receiving media information regarding image receiving media available in the image receiving media supply 700, or otherwise available to the image receiving device 100, to the control circuitry 600. This image receiving media information may include, but not be limited to, individual image receiving medium thickness and/or other characteristics that will affect an overall estimate of a stacking thickness for a set of image receiving media associated with a particular image forming operation. It should be appreciated that the image receiving media information may include, but not be limited to, medium thickness, medium stacking thickness, medium stacking thickness based on effects imposed on the print medium during image forming, medium stacking thickness based on medium composition, and/or medium stacking thickness based on deposited toner thickness. It should be appreciated that the medium stacking thickness may also be based on deposited toner thickness as scaled in accordance with an amount of estimated deposited toner per page.

The space available in each of the plurality of output stackers 200, 300, 400 may vary based on factors such as, for example, stacker depth and the presence of other image receiving media affecting usable stacker space. Available stacker space relevant to each of the plurality of output stackers 200, 300, 400 may be known, estimated or otherwise detected in a variety of ways such as, for example, detecting adjustments in stacker depth and monitoring used output stacker space.

Various configurations of individual output stackers may be estimated or detected such as, for example, those depicted in FIG. 1. For example, the image forming device 100 or the control circuitry 600 may provide a capability to keep track of previous output image receiving media such that the thickness of exemplary output image receiving media 750, shown in output stacker 300 in FIG. 1, is known. Such predetermination may allow the image forming device 1000 or the control circuitry 600 to calculate remaining stacker space (B). The output destination stacker may also accommodate an adjustable depth stacker, such as output stacker 400, that may traverse regions (C) and (D), resulting in different values for an available stacker space in, for example, region (C).

Figure 2:
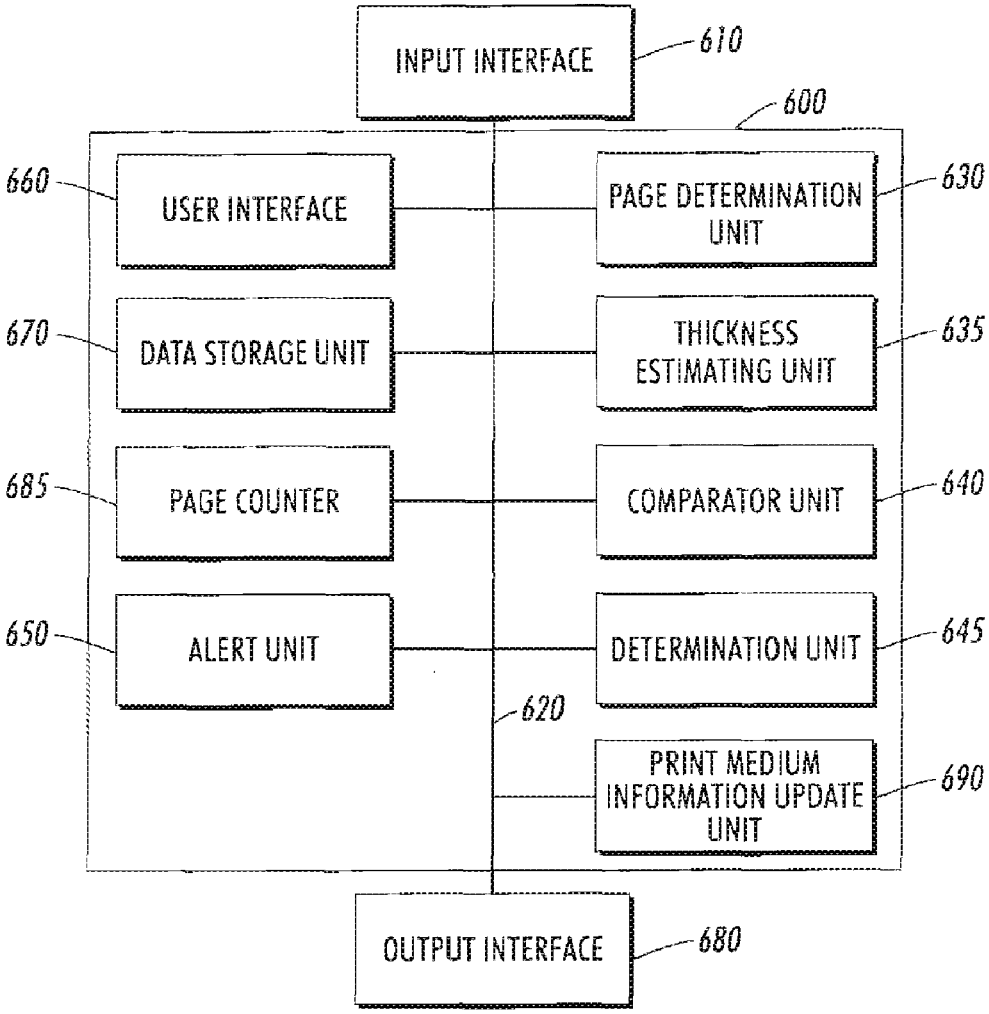
FIG. 2 is a schematic block diagram of an exemplary system for implementing a method to process an image forming operation based on an estimated stacking thickness of output image receiving media associated with the image forming operation.

FIG. 2 is a schematic block diagram in more detail of an exemplary control circuitry 600, as shown in FIG. 1, for implementing a method to process an image forming operation based on estimated stacking thickness in an image forming device. The exemplary control circuitry 600 may be connected to an input interface 610, which may provide information on a desired image forming operation to be undertaken in the image forming device. This information may be in the form, for example, of a print request including electronic image information, instructions, and/or header information received from an electronic data storage or generation source via the input interface 610. The control circuitry 600 may include a page determination unit 630, a thickness estimating unit 635, a comparator unit 640, a determination unit 645, an alert unit 650, a user interface 660, at least one data storage unit 670, a page counter 685, a print medium information update unit 690, all of which may be connected via a data/control bus 620.

The page determination unit 630 may be used to evaluate information received regarding a requested image forming operation in an image forming device to determine a number of pages required to complete the requested image forming operation based on a number of factors including the specific output image receiving medium available or specified. As used herein, such determinations may include estimates. Such determinations may be provided to the image forming device through exterior means or based on complete or partial image forming operation data or information. The determinations may be scheduled in the image forming operation and/or use information such as, for example, that contained in a header portion of an image forming operation data stream, and/or may take into account such factors as formatting requirements or limitations based on the image forming operation data or available image receiving medium information. The determined page count may be communicated to a thickness estimating unit 635.

The thickness estimating unit 635 may access an image receiving medium information storage unit 710 (as shown in FIG. 1) via the data/control bus 620 and a combination of the input interface 610 and output interface 680. It should be appreciated that information as discussed above being stored in the image receiving medium information storage unit 710, may also, alternatively or otherwise be stored in a data storage unit 670 of the control circuitry 600. The thickness estimating unit 635 may use the page determination provided by the page determination unit 630 and the image receiving medium information provided by image receiving medium information unit 710, or otherwise, to estimate a stacking thickness for the requested image forming operation. Such estimate may take into account a variety of factors and types of image receiving medium information relevant to estimating stacking thickness. The specific types of information discussed in this disclosure are intended to be exemplary and/or illustrative and should not be construed as limiting the scope of the information contemplated by this disclosure to any specific type or group of types or information.

The control circuitry 600, having computed an estimating stacking thickness for the requested image forming operation may further process execution of the image forming operation based on the estimated stacking thickness in a variety of manners.

The estimated stacking thickness may be, for example, communicated to a comparator unit 640. The comparator unit 640 may access an available stacker space and compare the available stacker space to the estimated stacking thickness, A determination unit 645 may determine whether, based on the comparison in the comparator unit 640, there is available stacker space to accommodate a fall set of image receiving media associated with the requested image forming operation. In this case. "accommodate" should be understood as representing space greater than or equal to the estimated stacking thickness with such modifications as may be desirable, or necessary, based on particular system, i.e., image forming device or output destination stacker, or specific user-defined, parameters.

The determination unit 645 may be configured to access a plurality of available stacker spaces via the input interface 610 or otherwise in sequence or concurrently, to determine a target stacker to which to deliver the full set of image receiving media associated with the requested image forming operation in accordance with the estimated stacking thickness.

The control circuitry 600 may be configured to provide an alert, via, for example, an alert unit 650, should one or more available stacker spaces be insufficient to receive the full set of image receiving media associated with the requested image forming operation based on the estimated stacking thickness.

Should an alert be generated in, for example, an alert unit 650, it may be displayed on a user interface 660 that may also allow a user to instruct the control circuitry 600 whether to proceed with the image forming operation, or to take other action such as, for example, inhibiting the image forming operation until a sufficient stacker space may become available, or reformatting or canceling the image forming operation in the image forming device. It should be appreciated that, if a determination is made, by the control circuitry 600, based on a user input or otherwise, not to proceed immediately with an image forming operation, the data relevant to the image forming operation may be stored in a data storage unit 670 until such time as the user may instruct, or otherwise the control circuitry may determine to proceed with, for example, continuation or cancellation of the image forming operation.

The control circuitry 600 may also employ the page counter 685 to monitor a number of pages output to particular output stackers. The page counter 685 may be used in conjunction with image receiving medium information to estimate remaining available stacker space based on an estimated stacking thickness of pages of image receiving media already counted as having been deposited in a specified stacker. Remaining stacking space may be determined by monitoring the travel of stackers 300 or 400 through ranges such as (B) and (D). Further, the page counter 685 may be used in conjunction with available stacker space data to further refine estimated available stacker space and/or update information in the image receiving medium information storage unit 710 via a print medium information update unit 690.

The print medium information update unit 690 may record information such as, for example, a sensed or otherwise measured actual stacking thickness of a full set of image receiving media associated with a requested image forming operation based on information such as page counts provided by page counter 685, and historical, or real-time, available stacker space information, to further define and/or update medium information in the image receiving medium information storage unit 710, the data storage unit 670, or otherwise in the control circuitry 600 for the particular image forming device.

The control circuitry 600 may also be connected to an output interface 680 usable to receive and/or communicate data such as, for example, historical information, medium information, and/or available stacker space relevant to image forming devices to other data repositories, or to other beneficial purposes both local and remote. One or both the input interface 610 and the output interface 680 may be network connected to facilitate data exchange with any manner of remote or local data source or data sink. Such communication may allow the system to perform such functions as, for example, acquiring updated medium information and/or distributing an image forming operation to a separate image forming device with available stacker space.

It should be appreciated that, given the required inputs, software algorithms, hardware/firmware circuits, and/or any combination of software and hardware/firmware control elements may be used to implement individual devices, and/or units, in the exemplary control circuitry 600.

It should be appreciated that although depicted in FIG. 2 as individual devices and/or units generally internal to the exemplary control circuitry 600, the individual devices and/or units may be combined and/or separately attached to the control circuitry 600 individually or as combined devices and/or units, attached to the control circuitry 600 by any data communication path that facilitates communication and coordination with the control circuitry 600 and/or an image forming device with which the control circuitry is associated through one or more of wired, wireless, and/or optical connections.

Any data storage unit described above such as, for example, those described as being internal to either the control circuitry 600, or associated with the image forming device as, for example, an image receiving media information storage unit 710 (see FIG. 1), may be implemented by any appropriate combination of alterable, volatile or non-volatile memory, or non-alterable, or fixed, memory. The alterable memory, whether volatile or non-volatile, may be implemented using any one or more of static or dynamic RAM, a computer disk and compatible disk drive, a writeable or a re-writeable optical disk and associated disk drive, a hard drive, a flash memory, a hardware circuit, a firmware circuit, or any other like memory medium and/or device. Similarly, the non-alterable, or fixed, memory may be implemented using any one or more of ROM, PROM, EPROM, EEPROM, and optical ROM disk, such as a CD-ROM or DVD-ROM disk with a compatible disk drive, or any other like memory storage medium and/or device.

As depicted in FIG. 2, the control circuitry 600 may also be configured to update the print medium information via, for example, a print medium information update unit 690, based on stacking information gathered from the image forming device 100. Such stacking information may include, for example, stacking height per page count, stacking height relative to medium composition, or other relevant information.

Figure 3:
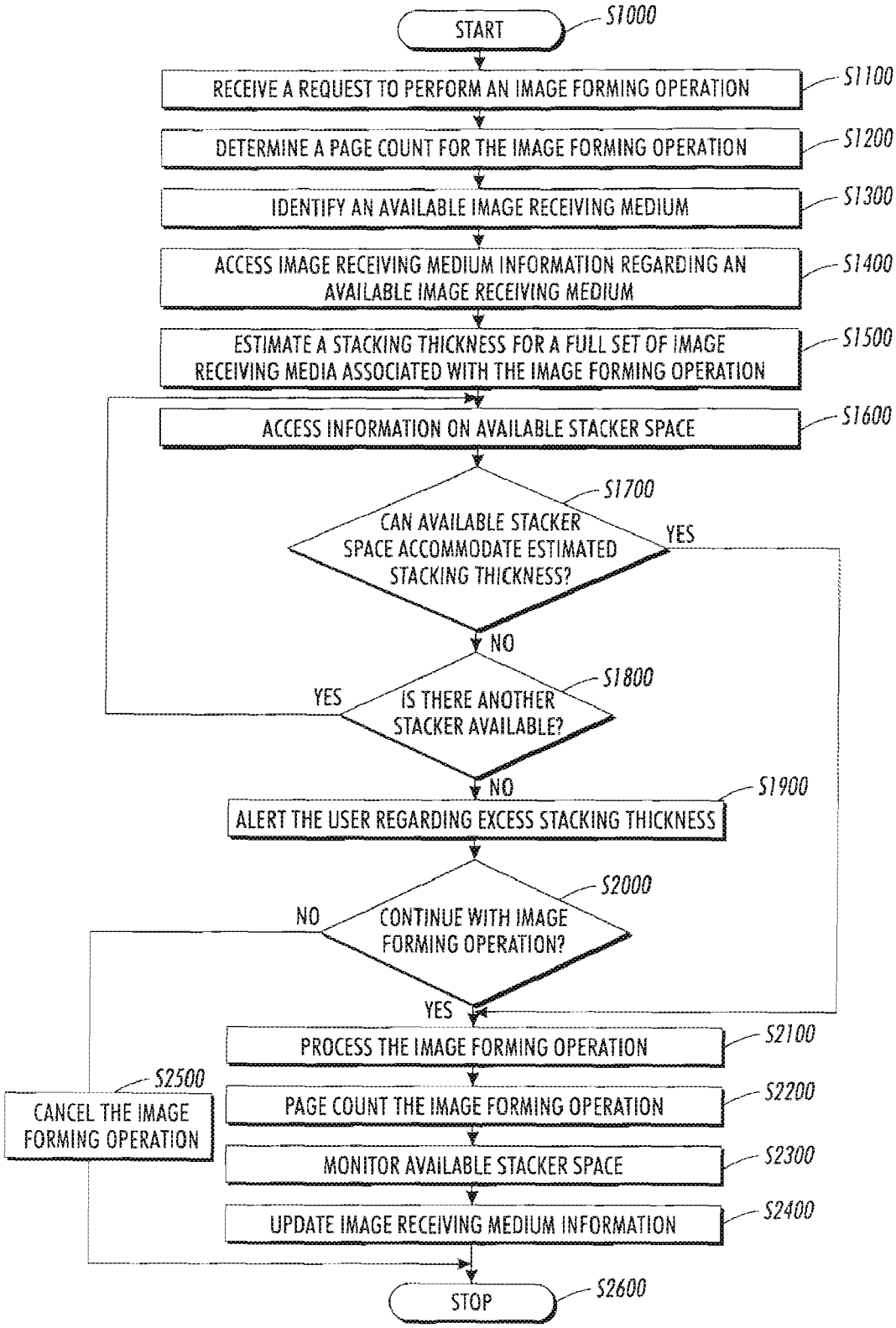
FIG. 3 is a flowchart outlining an exemplary method for controlling output of finished image receiving media in an image forming device based on an estimated stacking thickness of a full set of output media associated with the image forming operation.

FIG. 3 is a flowchart outlining an exemplary method for outputting finished medium in an image forming device based on an estimated stacking thickness. Exemplary embodiments include estimating a stacking thickness based on a determined page count and print medium information and processing an image forming operation based on the estimated stacking thickness.

Exemplary methods may include generally receiving an image forming operation request in an image forming device; evaluating the image forming operation to determine a number of pages required to complete the image forming operation based on a number of factors generally related to formatting and available image receiving media; accessing image receiving medium information relative to an image receiving medium, and processing of the image forming operation in the image forming device, usable by the image forming device to aid in stacking thickness estimation; estimating a stacking thickness based on the determined page count and the image receiving medium, and other, information; and processing the image forming operation based on the estimated stacking thickness.

As depicted in FIG. 3, exemplary methods may commence during step S1000 and proceed to step S1100 in which an image forming operation request or instruction may be received in an image forming device. Operation of the method continues with S1200.

In step S1200, the image forming operation may be evaluated to determine a number of pages required. As mentioned previously, determining a number of pages required may include estimating a number of pages required. It should be appreciated that such analysis may take place prior to complete receipt of the image forming operation. Examples of this may include wherein page count information is pre-processed and communicated distinctly with the image forming operation instructions, contained in header information distinct from the electronic image information and/or data, or in cases where the number of pages may be determined by other attributes of a partially-received image forming operation data file. Operation of the method continues with S1300.

In step S1300, an image receiving medium is identified for the image forming operation. Appropriate image receiving media may be identified in a variety of known methods such as, for example, matching an image receiving medium with image forming operation request information or sizing the image forming operation to a medium known to be available to the image forming device. Such image receiving medium may be directly available to the particular image forming device, or, in the case of networked devices, available to another accessible image forming device. Operation of the method continues to optional step S1400 or directly to step S1500.

In step S1400, image receiving medium information relevant to the identified image receiving medium, and usable to aid in estimating a stacking thickness of a full set of image receiving media associated with the requested image forming operation, may be accessed. Such information may be contained, for example, electronic storage memory within, or accessible by, the image forming device or other related device for implementing this exemplary method. The image receiving medium information may have been loaded in a variety of known or later discovered methods such as, for example, electronic storage resident on resource packaging, electronic transmission over a network, or manual input of identifying information sufficient to access other stored image receiving medium information locally or via a network. Operation of the method continues to step S1500.

In step S1500, stacking thickness may be estimated based on the determined page count and the accessed image receiving medium information. This estimated stacking thickness may form the basis for further processing of the requested image forming operation in the image forming device as discussed in the following steps. Operation of the method continues with S1600.

In step S1600, an available stacker space may be accessed. Such available stacker space may represent, for example, available stacker space in a currently selected stacker, space in an otherwise available stacker available to receive finished image receiving media from the image forming device, or space in an available stacker available to receive finished image receiving media from a networked image forming device. Operation of the method continues with S1700.

It should be appreciated that the method may select an available stacker based on a number of variables including, for example, the stacker with the most available space, most recently accessed stacker, or other like relevant information to the image forming operation.

It should also be appreciated that accessing an available stacker space may also represent simultaneously accessing available stacker space for two or more available stackers such as, for example, in the case of two-up printers that deliver finished image receiving media to a plurality of stacking stackers nearly simultaneously. In such instances, and others, it may be desirable and/or beneficial to configure control circuitry to assess multiple stackers simultaneously.

Stackers may be deemed to have an available stacker space in a variety of manners. The determination may include reference to a known space, such as that based on fixed or adjustable system parameters including stacker depth or travel. The determination may also include direct sensing of utilized space and/or open space of stackers. Such sensing methods may include optical, electrical, mechanical or various other known methods, and combinations thereof, that detect the presence and/or absence of material in a given space. The determination may also include reference to calculated values based on page counts of previously output image receiving medium delivered to an output stacker, print medium information, historical stacking thickness information and similar information stored in the data storage unit 670 or image receiving media information storage unit 710, or accessed via the input interface 610 and/or the output interface 680.

In step S1700, a determination is made whether an available stacker space can accommodate the estimated stacking thickness determined above. In this regard, the estimated stacking thickness may be compared to an available stacker space. If in step S1700, the determination is made that the available stacker space is sufficient to accommodate the estimated stacking thickness, the operation of the method continues to S2100.

If in step S1700, the determination is made that available stacker space is not sufficient to accommodate the estimated stacking thickness, operation of the method continues to step S1800.

In step S1800, a determination is made whether another stacker is available, which may not have been previously accessed, to accommodate the estimated stacking thickness. If in step S1800 a determination is made that another output stacker is available operation of the method may revert to step S1600. If in step S1800, a determination is made that there is not another stacker available to accommodate the estimated stacking thickness, operation of the method continues to step S1900.

It should be appreciated that such available stackers may be available to receive finished image receiving media from the image forming device, or available to received finished image receding media from a connected image forming device.

If in step S1800, operation of the method reverts to step S1600, access to a new available stacker and information regarding the available stacker space in that stacker is accessed.

In step S1900 a user may be alerted to the lack of sufficient available stacker space to receive a full set of image receiving media associated with an image forming operation in the image forming device. Operation of the method continues to step S2000. In step S2000 a determination is made whether to continue the image forming operation. If in step S2000 a determination is made not to continue the image forming operation, operation of the method continues to step S2500.

If in step S2000, a determination is made to continue the image forming operation, operation of the method continues to step S2100.

In step S2100, the image forming operation is processed. Such processing may include delivery of finished image receiving media to a selected output stacker that has been selected based on an ability to accommodate a full set of output image receiving media associated with the image forming operation based on an estimated stacking thickness of that full set of image receiving media. Such processing may also include transmission of the image forming operation to a networked image forming device for processing and delivery of the image forming operation to a remote identified available stacker. Operation of the method may continue directly to step S2600, or may continue to any one of optional steps S2200, S2300, or S2400.

In step S2200 pages delivered to the target output stacker may be counted, that count may be saved. Operation of the method may continue directly to step S2600 or to optional steps S2300 or S2400.

In step S2400, stacker space used as a result of the image forming operation is monitored and such monitored information may be optionally saved. Operation of the method continues directly to step S2600, or may optionally continue to step S2400.

In step S2400, image receiving medium information may be updated based on the monitored and/or saved page counts and used stacker space derived in steps S1820 and S1840. Such updated information may be refined information relevant to a particular image forming device and may be optionally stored for a later access to any beneficial purpose for which such information may be used.

In the context of this disclosure and specifically the method, a "user" should be understood as including operators, administrators, and like persons, or automated systems, interacting with the image forming device for manually or automatically undertaking any of the available functions.

In step S2500, a determination has been made not to continue with the image forming operation. As such, a user may instruct the image forming device to continue with, hold, or cancel the image forming operation. If the user instructs that image forming operation continue, such an instruction may result in the image forming operation being partially processed to one available stacker, or fully processed and delivered to separate stackers.

If the user instructs that the image forming operation be canceled, operation of the method continues to step S2600 where operation of the method changes after canceling the image forming operation and removing it from memory.

Alternatively, the user may instruct the image forming operation be held, thereby allowing time for suitable adjustments to the stackers such as, for example, removing previously processed media, or adjusting stacker size, to better allow for delivery of the image forming operation to a single stacker and manual or automatic reversion to any previous step in the method may be directed.

It should be appreciated that functions disclosed in exemplary embodiments may be performed in various orders and/or manners, and the functions may support and/or include multiple iterations of the disclosed steps in the exemplary method. In accordance with exemplary embodiments, a computer program product may be provided for enabling a computer to control an image forming device to perform the disclosed methods. The computer program product may comprise software instructions that enable the computer to perform predetermined operations, and a computer readable medium bearing the software instructions.

It will be appreciated that various of the above-disclosed and other features and functions, or alternatives thereof may be desirably combined into different systems or applications. Various presently unforeseen or unanticipated alternatives, modifications, variations, or improvements therein may be subsequently made by those skilled in the art which are also intended to be encompassed by the following claims.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for outputting finished image receiving medium in an image forming device, comprising:

receiving instructions for an image forming operation in an image forming device;

evaluating the image forming operation to determine a page count required to complete the image forming operation;

accessing print medium information relevant to an image receiving medium available to the image forming device for completing the image forming operation;

estimating a stacking thickness for a full set of output image receiving media associated with the image forming operation, the estimated stacking thickness being determined based on the determined page count and the print medium information and further based on effects imposed on the output image receiving media during the image forming operation, the effects comprising:

deposited toner thickness, wherein the estimated stacking thickness based on the deposited toner thickness is scaled in accordance with an amount of estimated deposited toner per page of the output receiving media;

thermal expansion; and electrostatic charging; and processing the image forming operation based on the estimated stacking thickness.

2. The method of claim 1, wherein estimating the stacking thickness includes applying the accessed print medium information to the estimated page count to estimate the stacking thickness.

3. The method of claim 2, wherein the print medium information comprises print medium thickness.

4. The method of claim 2, wherein the print medium information comprises print medium stacking thickness.

5. The method of claim 4, wherein the print medium information comprises print medium stacking thickness based on print medium composition.

6. The method of claim 2, further comprising:

evaluating an actual stacking thickness of a full finished set of output image receiving media associated with the image forming operation; and updating the print medium information by control circuitry within the image forming device based on actual stacking thickness information gathered from the image forming device.

7. The method of claim 1, wherein evaluating the image forming operation takes place prior to complete receipt of the image forming operation.

8. The method of claim 1, wherein processing the image forming operation based on the estimated stacking thickness further comprises:

comparing the estimated stacking thickness to an available stacker space; and determining, from among a plurality of available output stackers, a target stacker to which to deliver the full set of output image receiving media associated with the image forming operation based on the results of the comparison.

9. The method of claim 8, further comprising generating an alert if there is not an available stacker space sufficient to accommodate the estimated stacking thickness.

10. The method of claim 9, further comprising suspending processing of the image forming operation until an available stacker space sufficient to accommodate the estimated stacking thickness is detected.

11. The method of claim 9, further comprising requesting a user input regarding at least one of continuing or canceling processing the image forming operation.

12. The method of claim 8, wherein an available stacker space comprises a plurality of available stacker spaces representing a plurality of available stackers between which the full set of output image receiving media associated with the image forming operation are accommodated based on the estimated stacking thickness.

13. A system for selecting an output stacker for output of image receiving media in an image forming device, comprising:

at least one output stacker for receiving output image receiving media in an image forming device;

an output control device that selectively directs output image receiving media in the image forming device to the at least one output stacker; and control circuitry, operatively connected to the image forming device and the output control device, configured to:

receive an image forming operation;

evaluate the image forming operation to determine a number of pages required;

access print medium information;

estimate a stacking thickness based on the determined number of pages required and the accessed print medium information and further based on effects imposed on the output image receiving media during the image forming operation, the effects comprising:

deposited toner thickness, wherein the estimated stacking thickness based on the deposited toner thickness is scaled in accordance with an amount of estimated deposited toner per page of the output receiving media;

thermal expansion; and electrostatic charging; and process the image forming operation based on the estimated stacking thickness.

14. The system of claim 13, wherein:

the at least one output stacker comprises a plurality of output stackers;

the output control device selectively directs output image receiving media from the image forming device to the plurality of output stackers; and processing the image forming operation comprises;

comparing the estimated stacking thickness to an available stacker space, determining, from among the plurality of available output stackers, a target stacker to which to deliver a full set of output image receiving media associated with the image forming operation based on the results of the comparison.

15. The system of claim 13, wherein print medium information comprises at least one of a print medium thickness, a print medium stacking thickness, and a print medium stacking thickness based on print medium composition.

16. The system of claim 13, wherein evaluating the image forming operation takes place prior to complete receipt of the image forming operation.

17. The system of claim 13, wherein the control circuitry is further configured to update the print medium information based on actual stacking thickness information gathered from the image forming device.

18. The system of claim 13, further comprising an alert unit that generates an alert if a determination is made that there is not an available stacker space sufficient to accommodate the estimated stacking thickness.

19. The system of claim 13, wherein processing the image forming operation further comprises suspending processing of the image forming operation until an available stacker space sufficient to accommodate the estimated stacking thickness is detected.

20. The system of claim 13, wherein processing the image forming operation further comprises requesting a user input regarding at least one of continuing or canceling processing the image forming operation if a determination is made that there is not an available stacker space sufficient to accommodate the estimated stacking thickness.

21. The system of claim 13, wherein an available stacker space comprises a plurality of available stacker spaces representing a plurality of available stackers between which the full set of output image receiving media associated with the image forming operation are accommodated based on the estimated stacking thickness.

22. A Xerographic printing device including the system of claim 13.

23. A computer program product, the computer program product comprising a non-transitory computer readable medium bearing software instructions that enable a computer to perform predetermined operations, the predetermined operations comprising:

receiving an image forming operation in an image forming device;

evaluating the image forming operation to determine a page count required to complete the image forming operation;

accessing print medium information relevant to a print medium available to the image forming device for completing the image forming operation;

estimating a stacking thickness for a full set of output image receiving media associated with the image forming operation based on the determined page count and the accessed print medium information and further based on effects imposed on the output image receiving media during the image forming operation, the effects comprising:

deposited toner thickness, wherein the estimated stacking thickness based on the deposited toner thickness is scaled in accordance with an amount of estimated deposited toner per page of the output receiving media;

thermal expansion; and electrostatic charging; and processing the image forming operation based on the estimated stacking thickness.

* * * * *